US007597208B2

(12) United States Patent
Wang

(10) Patent No.: US 7,597,208 B2
(45) Date of Patent: Oct. 6, 2009

(54) FOLDING COLLAPSIBLE STORAGE BOX

(76) Inventor: Wen-Tsan Wang, 6F., No. 300, Jui Kuang Rd., Taipei City (TW)

( * ) Notice: Subject to any disclaimer, the term of this patent is extended or adjusted under 35 U.S.C. 154(b) by 374 days.

(21) Appl. No.: 11/559,910

(22) Filed: Nov. 15, 2006

(65) Prior Publication Data

US 2008/0110969 A1 May 15, 2008

(51) Int. Cl.
*B65D 6/26* (2006.01)
*B65D 25/06* (2006.01)
*B65D 57/00* (2006.01)
*B65D 6/18* (2006.01)

(52) U.S. Cl. ..... 220/6; 220/520; 220/528; 220/531

(58) Field of Classification Search ..... 220/6, 220/9.2, 9.3, 666, 520, 521, 529; 190/107
See application file for complete search history.

(56) References Cited

U.S. PATENT DOCUMENTS 1,043,572 A * 11/1912 Donley ..... 206/174
3,073,367 A * 1/1963 Samara ..... 383/97
3,708,045 A * 1/1973 Katz ..... 190/115
5,964,533 A * 10/1999 Ziglar ..... 383/36
6,102,569 A * 8/2000 Wang ..... 383/104
6,238,091 B1 * 5/2001 Mogil ..... 383/110
6,601,743 B2 * 8/2003 Godshaw ..... 224/153
6,920,993 B2 * 7/2005 Sheng-Bin ..... 220/6
7,080,653 B2 * 7/2006 Zheng ..... 135/126
2002/0090150 A1 * 7/2002 Peska ..... 383/38
2003/0080125 A1 * 5/2003 Cassani ..... 220/6

* cited by examiner

*Primary Examiner*—Anthony D Stashick
*Assistant Examiner*—Niki M Eloshway
(74) *Attorney, Agent, or Firm*—Leong C. Lei

(57) ABSTRACT

A folding collapsible storage box is disclosed to include a folding collapsible box body, which has a front open side, a rear open side, a flexible rectangular cover flap stitched to two adjacent ones of the four peripheral sides of the rear open side, and a zip fastener that fastens the other two sides of the flexible rectangular cover flap to the other two adjacent ones of the four peripheral sides of the rear open side, a supporting board inserted into the rear open side of the folding collapsible box body to support the folding collapsible box body into shape after opening of the zip fastener, and partition boards mounted inside the folding collapsible box body to divide the holding space of the folding collapsible box body into multiple storage compartments.

3 Claims, 11 Drawing Sheets

FOLDING COLLAPSIBLE STORAGE BOX

BACKGROUND OF THE INVENTION (a) Technical Field of the Invention

The present invention relates storage boxes and more particularly, to a folding collapsible storage box.

(b) Description of the Prior Art

People usually use storage boxes or cabinets to keep clothes, personal items, and other articles. Conventional hard storage boxes may be made out of plastics, wooden material, metal, etc. These conventional hard storage boxes are not collapsible, and occupy much space during delivery. There are combination storage boxes that are packed in a detached condition. It uses many packing materials to pack a combination storage box in a detached condition. When purchased a combination storage box of this kind, the consumer may take a lot of time to set up the storage box.

SUMMARY OF THE INVENTION

The primary purpose of the present invention is to provide a storage box, which is folding collapsible. It is another object of the present invention to provide a folding collapsible storage box, which can easily and quickly be set up and collapsed. It is still another object of the present invention to provide a folding collapsible storage box, which saves much packing materials during delivery.

According to one aspect of the present invention, the folding collapsible storage box comprises a folding collapsible box body, which has a front open side, a rear open side, a flexible rectangular cover flap stitched to two adjacent ones of the four peripheral sides of the rear open side, and a zip fastener that fastens the other two sides of the flexible rectangular cover flap to the other two adjacent ones of the four peripheral sides of the rear open side, and a supporting board inserted into the rear open side of the folding collapsible box body to support the folding collapsible box body into shape after opening of the zip fastener.

According to another aspect of the present invention, the folding collapsible storage box further comprises a plurality of partition boards mounted inside the folding collapsible box body to divide the holding space of the folding collapsible box body into multiple storage compartments. The partition boards may be arranged in horizontal at different elevations to divide the holding space of the folding collapsible box body into multiple vertically spaced storage compartments, or arranged in vertical to divide the holding space of the folding collapsible box body into multiple horizontally spaced storage compartments. Alternatively, vertical partition board and horizontal partition boards can be used and intersected inside the folding collapsible box body to divide the holding space of the folding collapsible box body into multiple storage compartments.

According to still another aspect of the present invention, additional foldable auxiliary partition boards may be used to divide each storage space in the folding collapsible box body into multiple sub storage compartments.

According to still another aspect of the present invention, the supporting board is foldable, and the partition boards include relatively shorter vertical partition boards and relatively longer horizontal partition boards.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
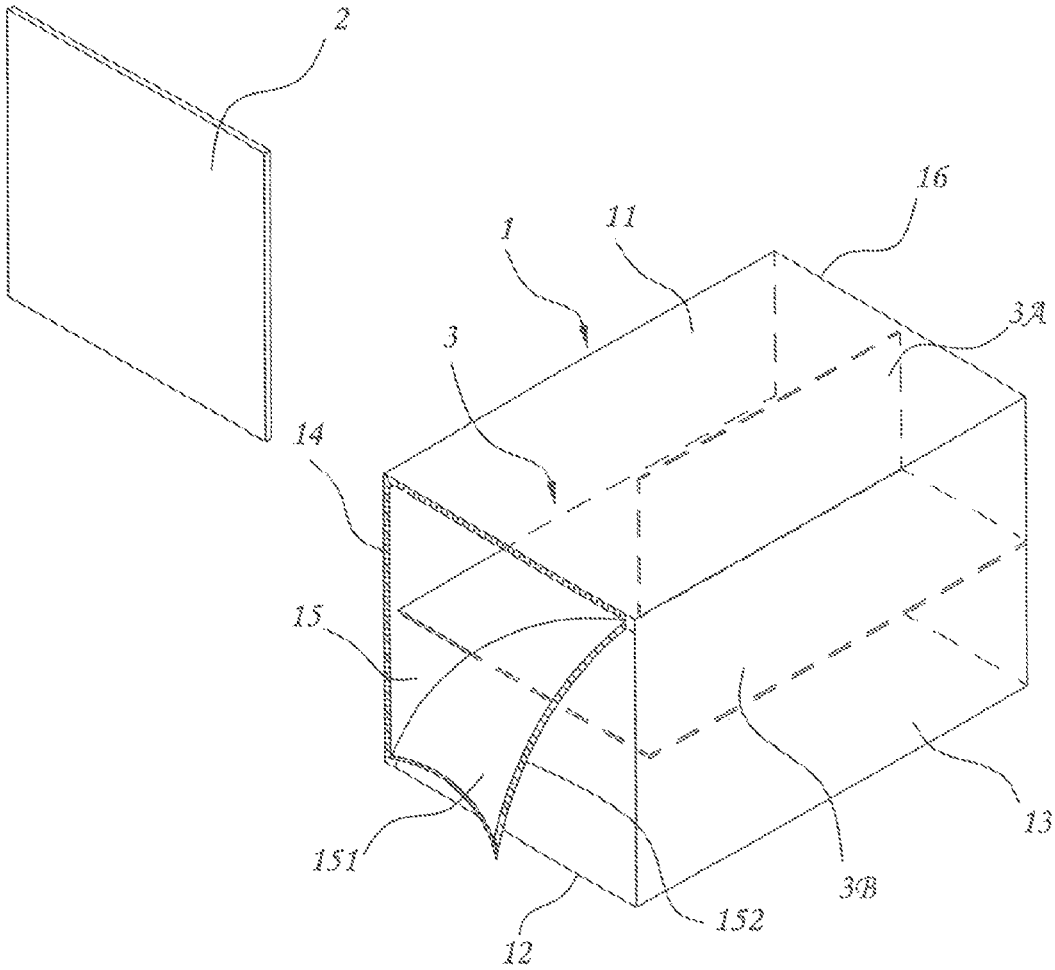
FIG. 1 is an exploded view of a folding collapsible storage box in accordance with a first embodiment of the present invention.

Referring to FIG. 1, a folding collapsible storage box in accordance with a first embodiment of the present invention is shown comprising a folding collapsible box body 1. The folding collapsible box body 1 has a top panel 11, a bottom panel 12, a left panel 13, and a right panel 14. The top, bottom, left and right panels 11~14 are respectively formed of a hard board wrapped with a soft covering. The soft coverings of the top, bottom, left and right panels 11~14 are stitched to one another so that each two adjacent panels are foldable relative to each other, i.e., the top, bottom, left and right panels 11~14 are hinged to one another. When the folding collapsible box body 1 is extended out, it shows a rectangular shape having a front open side 16 and a rear open side 15 opposite to the front open side 16. A flexible rectangular cover flap 151 has two adjacent side edges respectively stitched to the soft coverings of two adjacent ones of the top, bottom, left and right panels 11~14, and the other two adjacent side edges respectively detachably fastened to the soft coverings of the other two adjacent ones of the top, bottom, left and right panels 11~14 with fastening means 152. The fastening means 152 can be a zip fastener or hook and loop materials.

As stated above, the top, bottom, left and right panels 11~14 are respectively formed of a hard board wrapped with a soft covering, and the soft coverings of the top, bottom, left and right panels 11~14 are stitched to one another so that each two adjacent panels are foldable relative to each other. In order to support the folding collapsible box body 1 in shape (in the extended status), a supporting board 2 is used. The transverse width and vertical height of the supporting board 2 are approximately equal to the rear open side 15 of the folding collapsible box body 1. When the fastening means 152 (zip fastener or hook and loop materials) is unfastened, the supporting board 2 is inserted into the rear open side 15 and stopped against the inner surfaces of the top, bottom, left and right panels 11~14, thereby supporting the folding collapsible box body 1 in the extended status.

Figure 9:
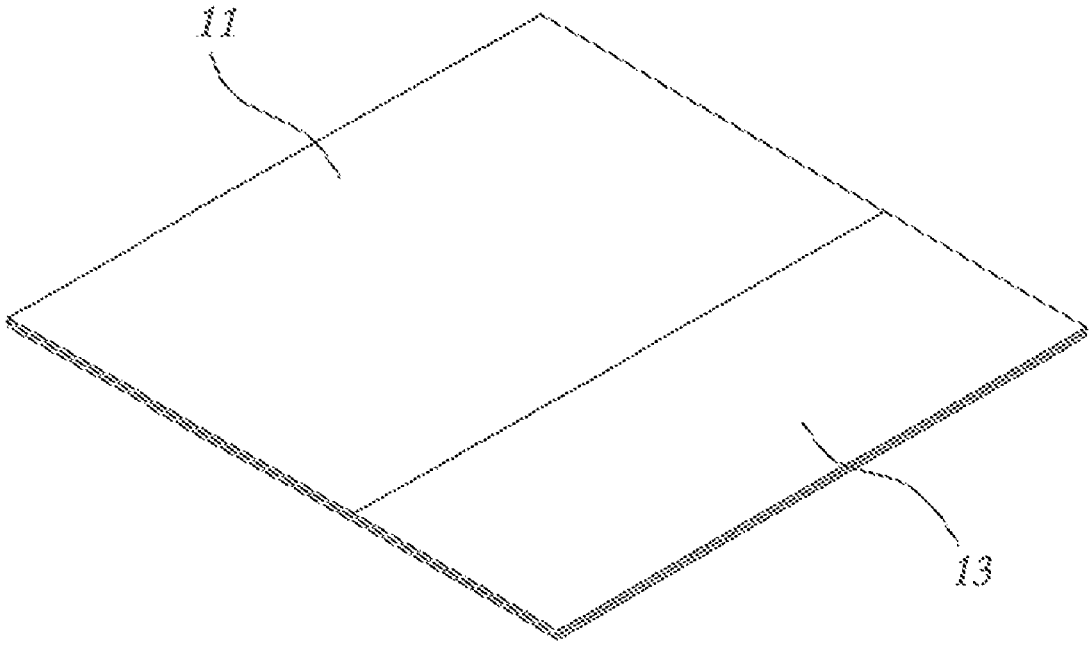
FIG. 9 illustrates the collapsed status of the folding collapsible box body according to the present invention.

When the folding collapsible storage box is not in use, the fastening means 152 is unfastened, and then the supporting board 2 is taken out of the folding collapsible box body 1, and then the folding collapsible box body 1 is collapsed into a flat manner as shown in FIG. 9.

Further, a partition member 3 may be inserted through the front open side 16 into the inside of the folding collapsible box body 1 to divide the inside space of the folding collapsible box body 1 into multiple compartments for keeping things. The partition member 3 may be directly stitched to the soft covering of each of at least one of the top, bottom, left and right panels 11~14. Alternatively, hook and loop materials may be used to secure the partition member 3 to the soft covering of each of at least one of the top, bottom, left and right panels 11~14.

Figure 2:
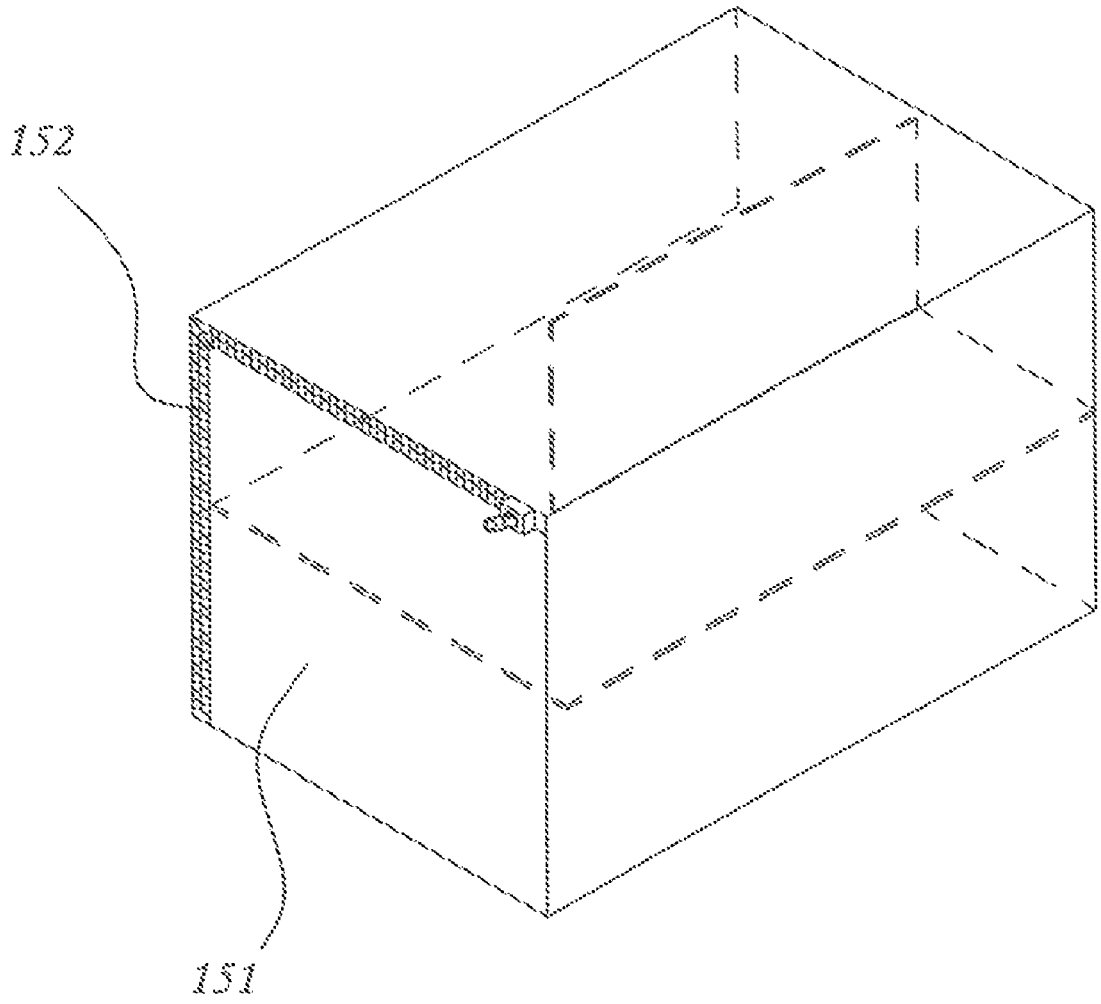
FIG. 2 is a perspective assembly view of the folding collapsible storage box according to the first embodiment of the present invention.

According to the embodiment shown in FIGS. 1 and 2, the partition member 3 is comprised of a vertical partition board 3A and a horizontal partition board 3B intersected with the vertical partition board 3A, i.e., the partition member 3 shows a crossed cross section.

Figure 3:
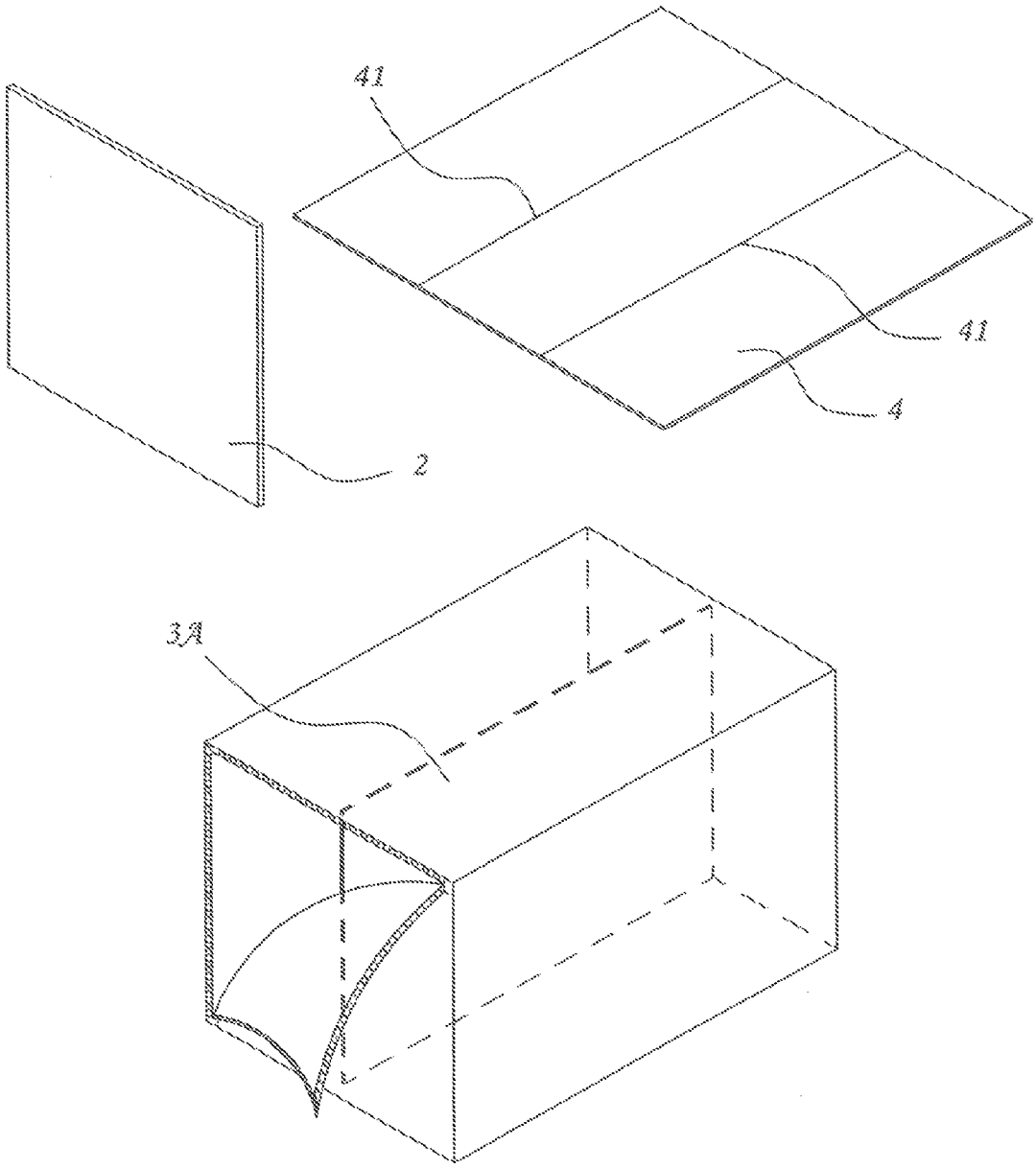
FIG. 3 is an exploded view of a folding collapsible storage box in accordance with a second embodiment of the present invention.
Figure 4:
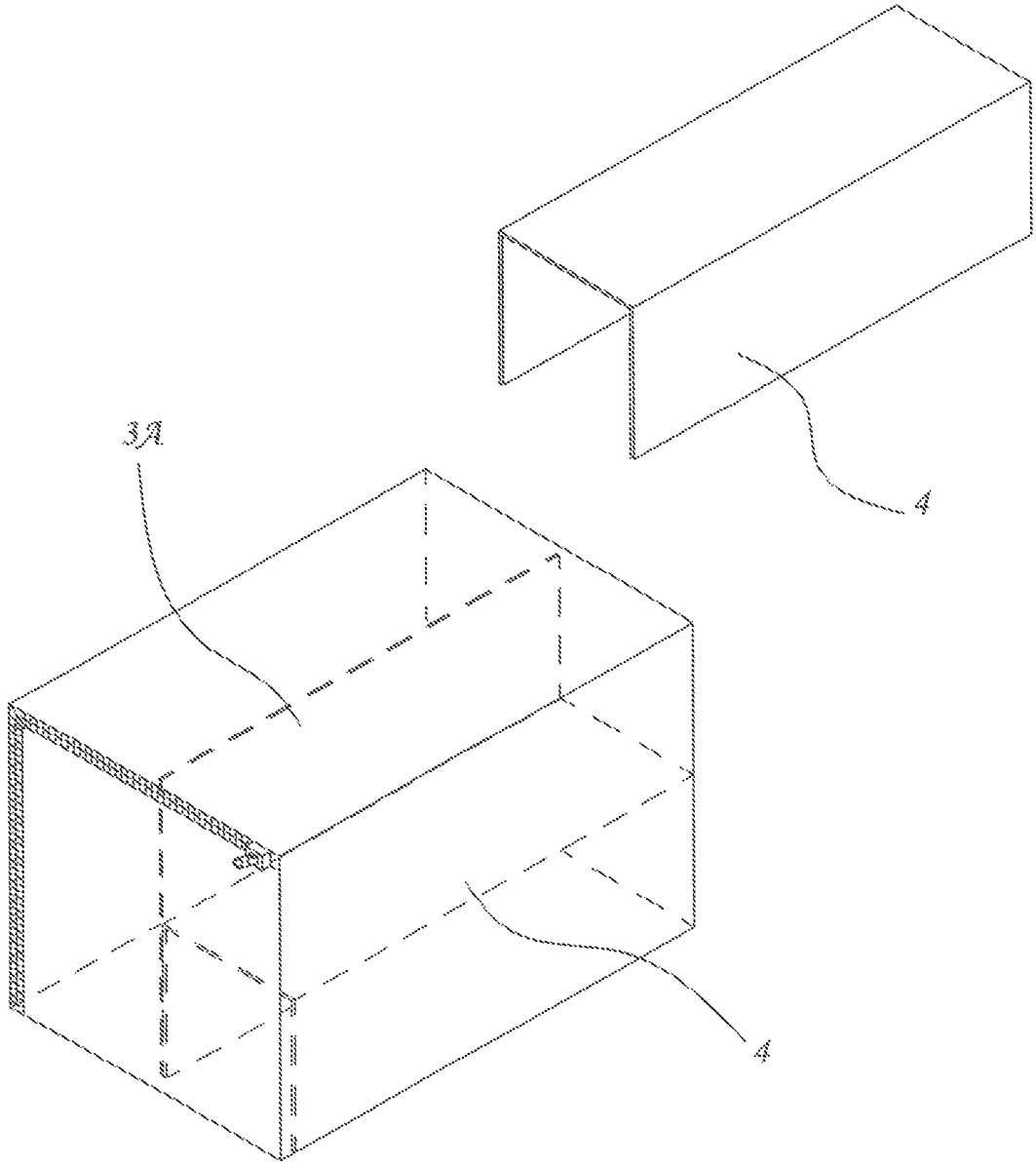
FIG. 4 is another exploded view of the second embodiment of the present invention, showing the auxiliary partition member folded into shape.

FIGS. 3 and 4 show a folding collapsible storage box in accordance with a second embodiment of the present invention. According to this embodiment, the folding collapsible storage box has a vertical partition board 3A fixedly fastened to the inside of the folding collapsible box body thereof to divide the inside space of the folding collapsible box body into two holding spaces, and a plurality of auxiliary partition members 4 respectively inserted into the storage compartments to separate each holding space into multiple storage compartments. Each auxiliary partition member 4 is a formed of a flat board having two parallel folding lines 41 extending to two opposite sides. Through the folding lines 41, each auxiliary partition member 4 is folded into an inverted U-shaped member before insertion into the folding collapsible box body.

Figure 5:
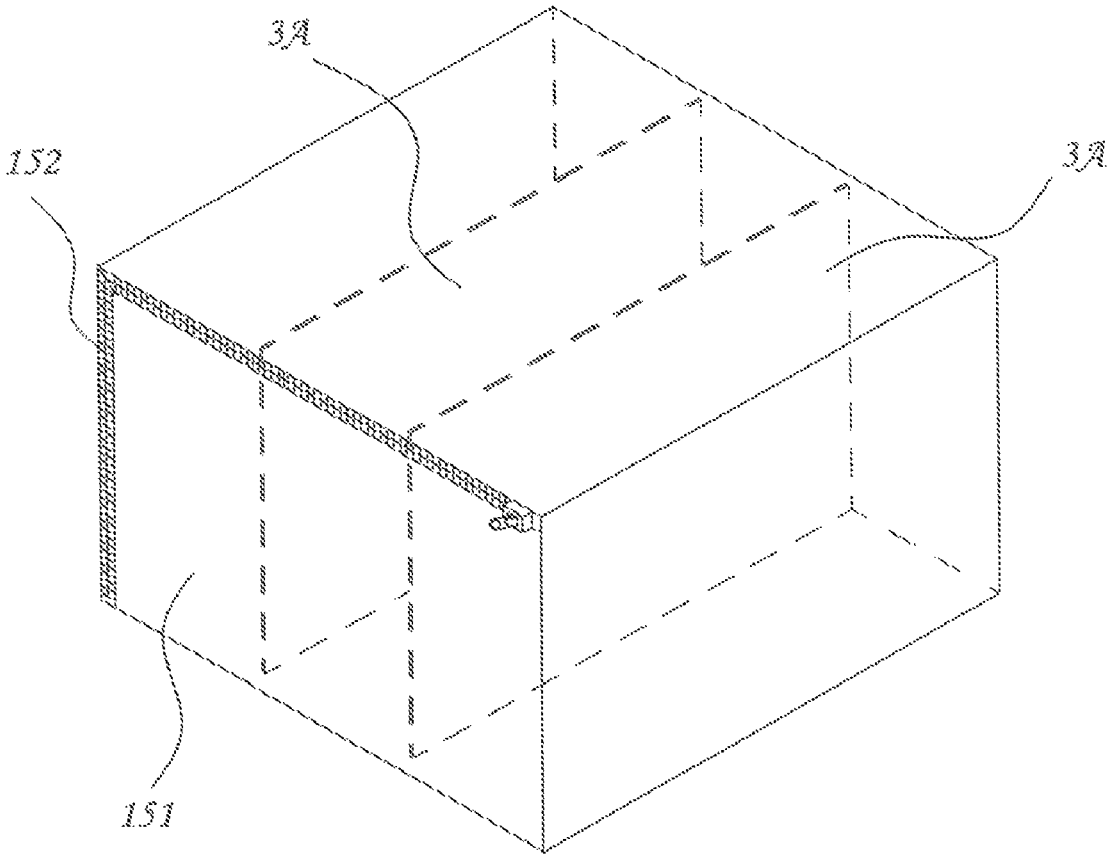
FIG. 5 is a perspective view of a folding collapsible storage box in accordance with a third embodiment of the present invention.

FIG. 5 shows a folding collapsible storage box in accordance with a third embodiment of the present invention. According to this embodiment, two vertical partition boards 3A are used and vertically arranged in parallel inside the folding collapsible box body.

Figure 5A:
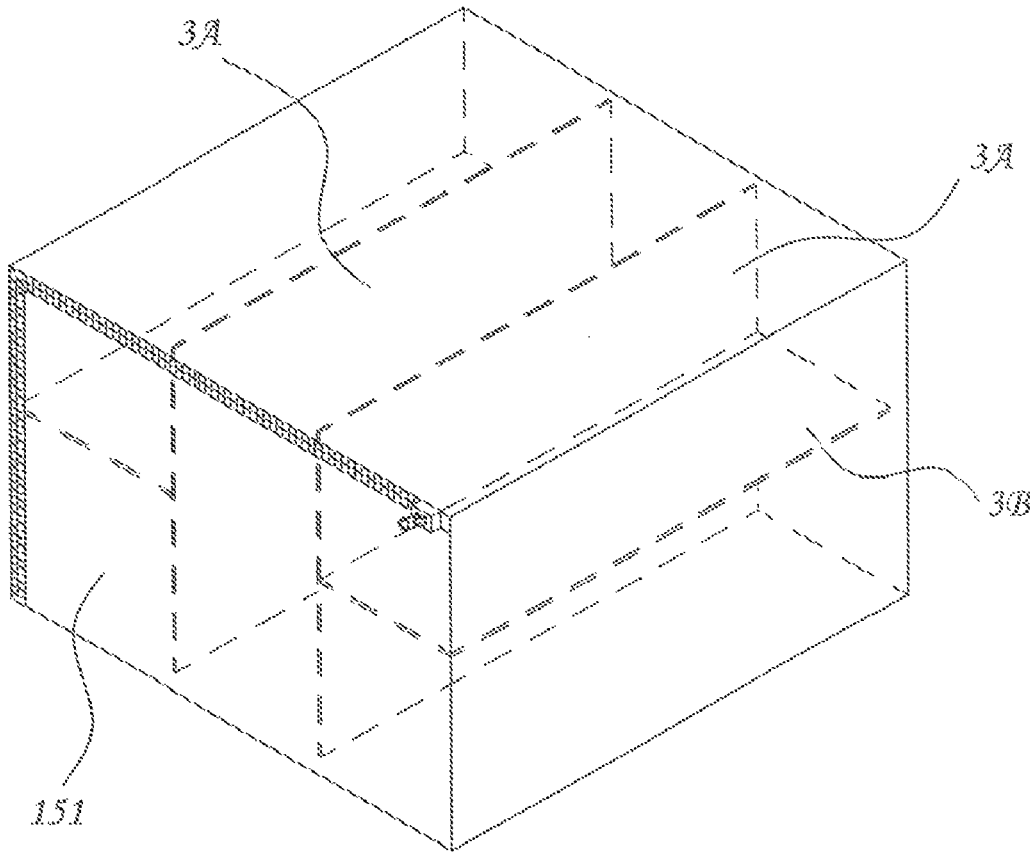
FIG. 5A is a perspective view of a folding collapsible storage box in accordance with a fourth embodiment of the present invention.

FIG. 5A is a perspective view of a folding collapsible storage box in accordance with a fourth embodiment of the present invention. According to this embodiment, multiple vertical partition boards 3A and multiple horizontal partition boards 3B are used and mounted inside the folding collapsible box body.

Figure 6:
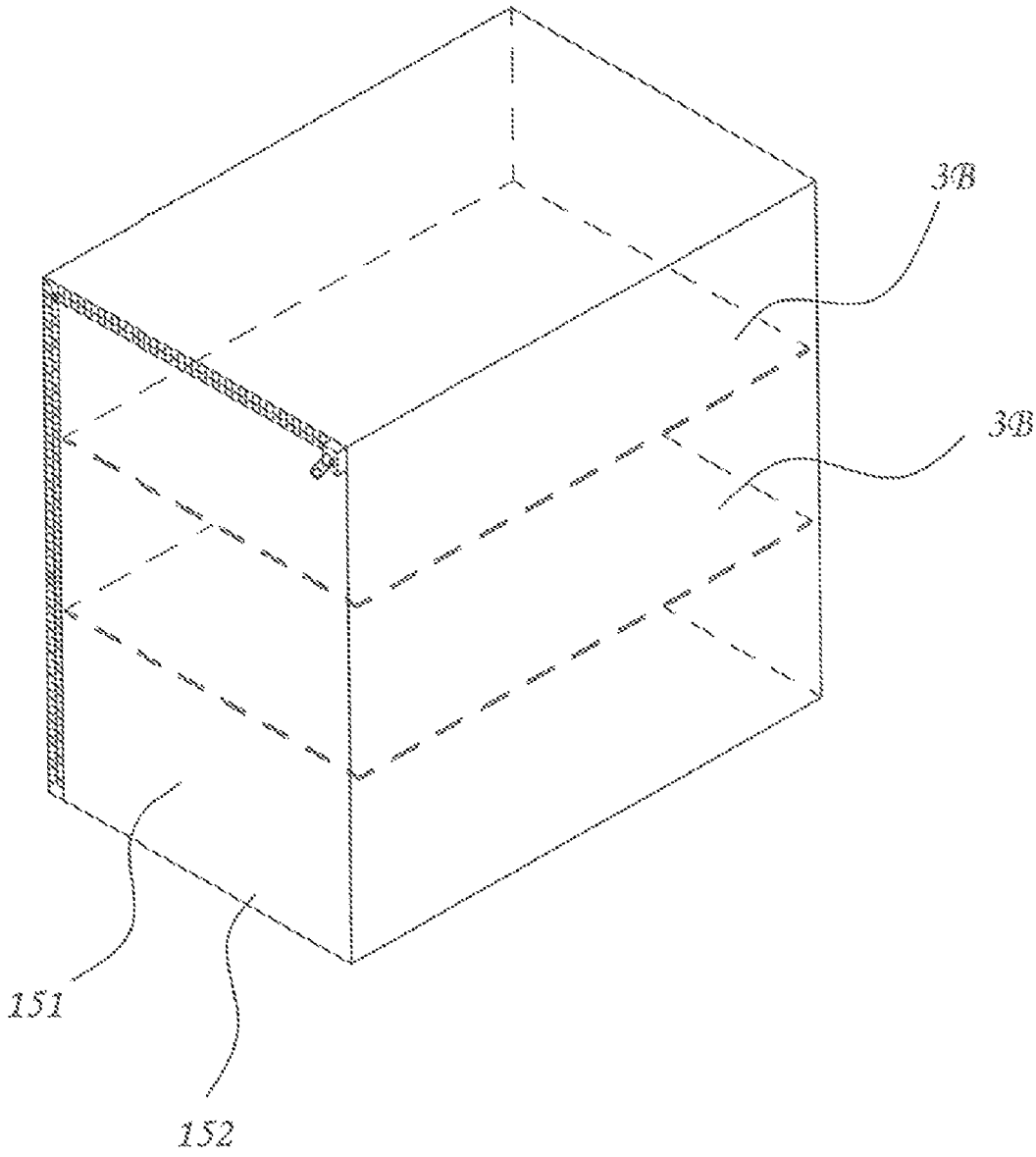
FIG. 6 is a perspective view of a folding collapsible storage box in accordance with a fifth embodiment of the present invention.

FIG. 6 is a perspective view of a folding collapsible storage box in accordance with a fifth embodiment of the present invention. According to this embodiment, multiple horizontal partition boards 3B are used and mounted inside the folding collapsible box body to divide the holding space of the folding collapsible box body into vertically spaced storage compartments.

Figure 6A:
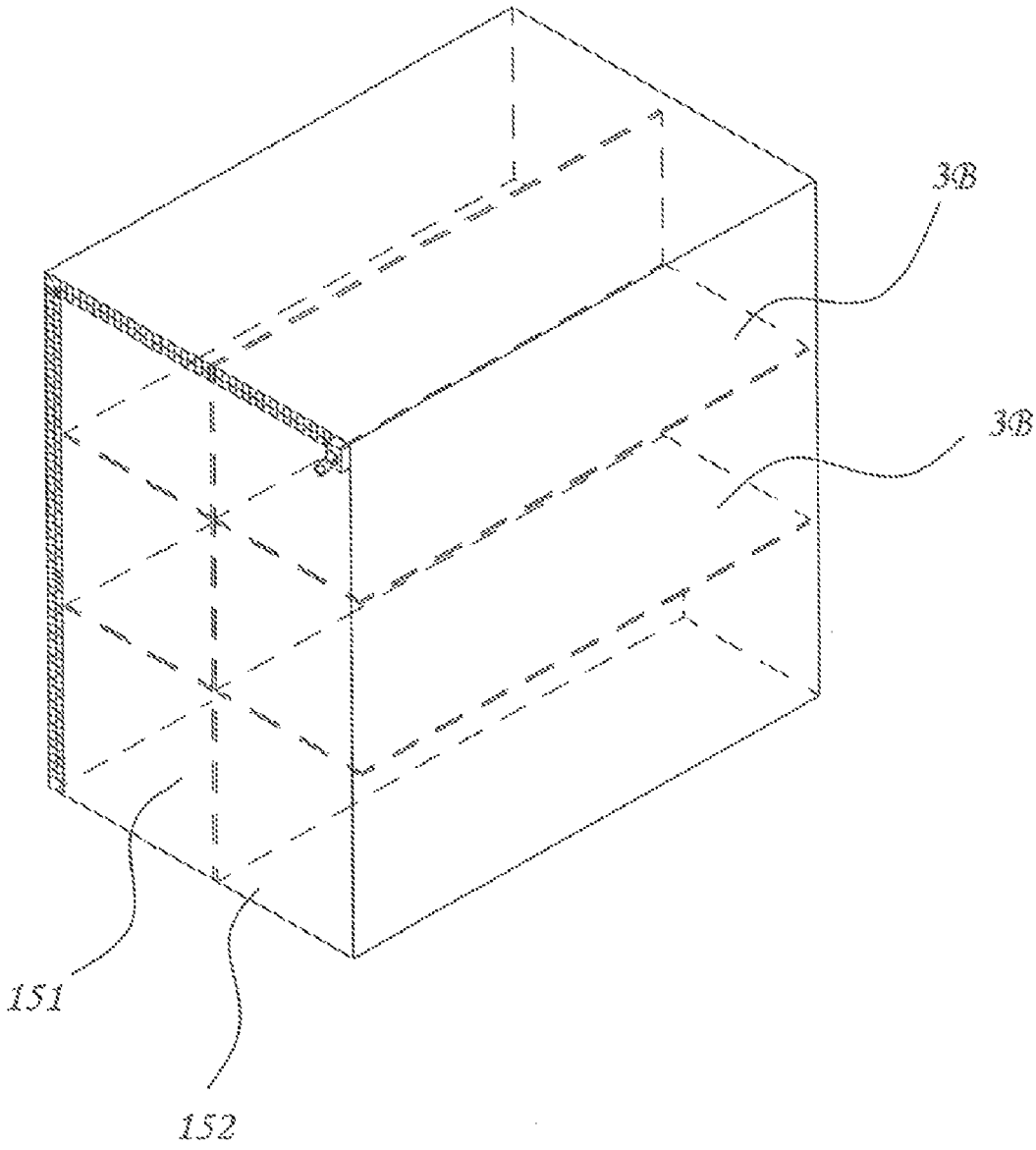
FIG. 6A is a perspective view of a folding collapsible storage box in accordance with a sixth embodiment of the present invention.

FIG. 6A is a perspective view of a folding collapsible storage box in accordance with a sixth embodiment of the present invention. This embodiment is substantially similar to the embodiment shown in FIG. 6 with the exception of the use of additional vertical partition boards 3A that divide the vertically spaced storage compartments into more number of relatively smaller storage compartments.

Figure 7:
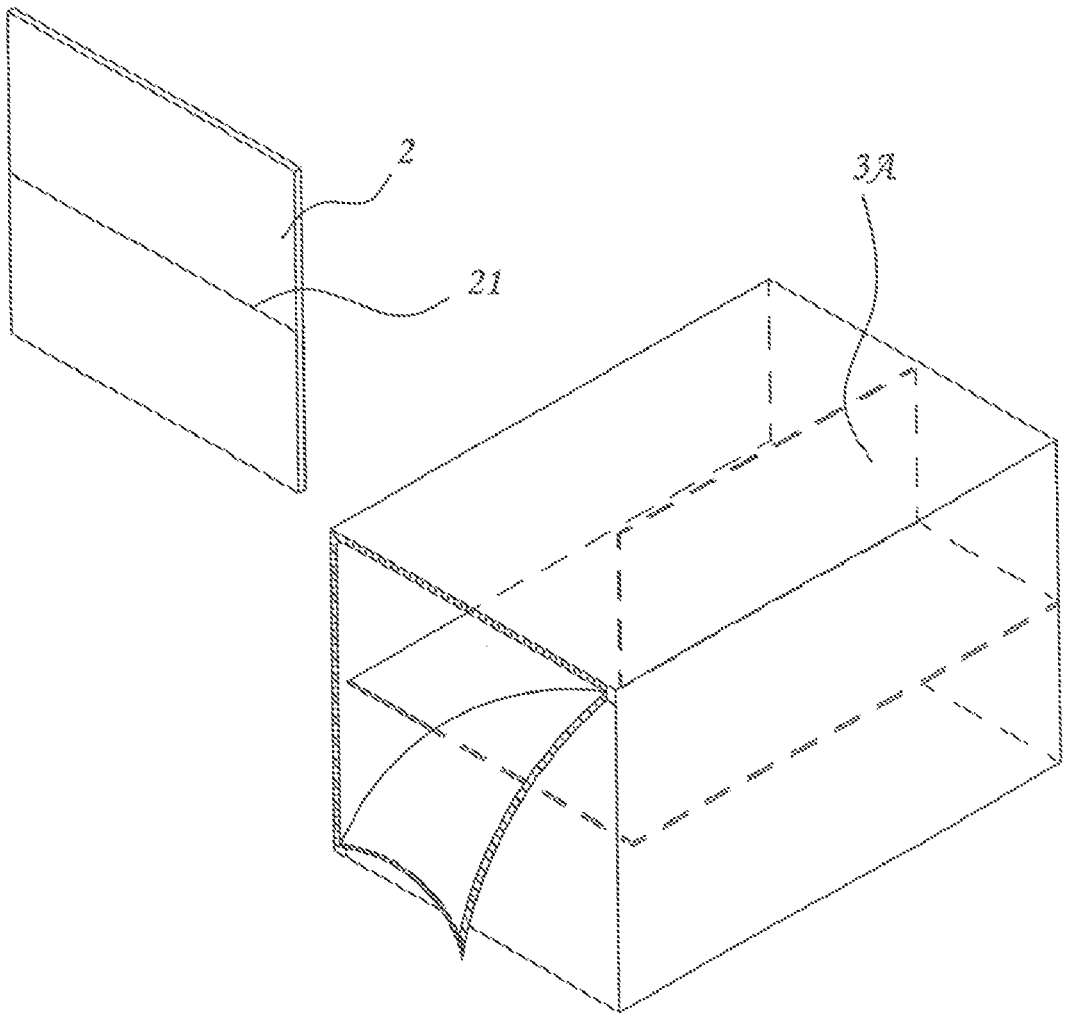
FIG. 7 is an exploded view of a folding collapsible storage box in accordance with a seventh embodiment of the present invention.
Figure 8:
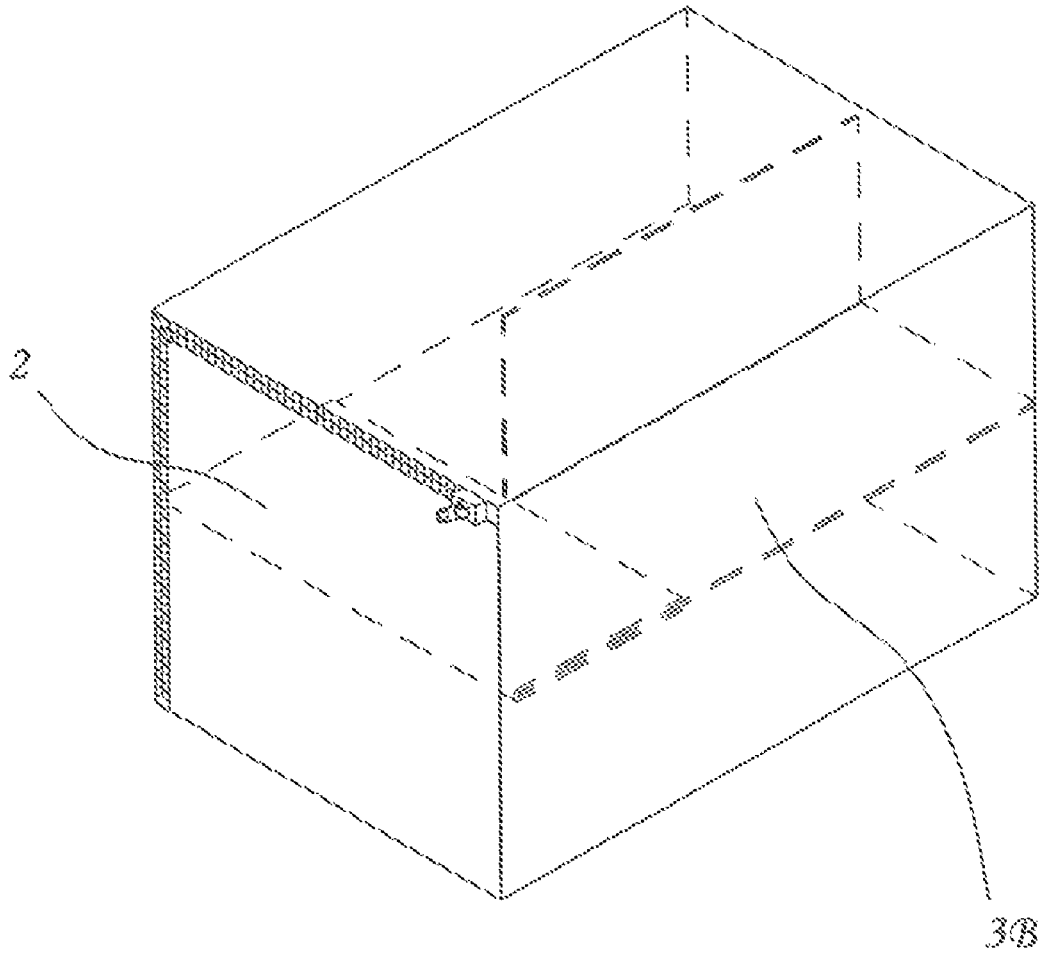
FIG. 8 is a perspective view of the seventh embodiment of the present invention, showing the supporting board folded up and stacked on the horizontal partition board inside the folding collapsible box body.

FIGS. 7 and 8 show a folding collapsible storage box in accordance with a seventh embodiment of the present invention. According to this embodiment, the supporting board 2 has a transverse folding line 21 on the middle, and the vertical partition board 3A is relatively shorter than the horizontal partition board 3B. When not in use, the supporting board 2 can be directly folded up and stacked on the horizontal partition board 3B (see FIG. 8) before collapsing the folding collapsible box body.

Although particular embodiments of the invention have been described in detail for purposes of illustration, various modifications and enhancements may be made without departing from the spirit and scope of the invention. Accordingly, the invention is not to be limited except as by the appended claims.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A folding collapsible storage box comprising:

a box body having a top panel, a bottom panel, a left panel and a right panel, said panels being respectively formed of a hard board wrapped with a soft covering, said soft covering of said panels being stitched to one another so that each two adjacent ones of said panels are foldable relative to each other, said left and right panels being hinged to one another in such a manner that said top panel, said bottom panel, said left panel and said right panel are collapsible into a flat manner and settable into a hollow rectangular structure having a front open side and a rear open side and a storage space in communication between said front open side and said rear open side;

a flexible rectangular cover flap having first two adjacent side edges and second two adjacent side edges, said first two adjacent side edges being respectively stitched to two adjacent side edges of said top panel, said bottom panels, said left panel and said right panel;

fastening means fastening said second two adjacent side edges of said flexible cover flap to the other tow adjacent side edges of said top panel, said bottom panel, said left panel and said right panel;

partition means including a vertical partition board and an auxiliary partition member, said vertical partition board fixedly fastened to an inside of said box body to divide an inside space of said box body into two holding spaces, said auxiliary partition member being formed of a flat board having two parallel folding lines extending to two opposite sides thereof, said auxiliary partition member being folded into an inverted U-shaped member and then inserted into said box body; and a supporting board inserted into said rear open side and stopped against inner surfaces of said top, bottom, left and right panels thereby supporting said box body in an extended status.

2. The folding collapsible storage box as claimed in claim 1, wherein said fastening means is a zip fastener.

3. The folding collapsible storage box as claimed in claim 1, wherein said fastening means is hook and loop materials.

* * * * *